US006267533B1

(12) United States Patent
Bourg

(10) Patent No.: US 6,267,533 B1
(45) Date of Patent: Jul. 31, 2001

(54) EROSION CONTROL SYSTEM

(76) Inventor: George S. Bourg, 4133 Grand Caillou Rd., Houma, LA (US) 70363

( * ) Notice: Subject to any disclaimer, the term of this patent is extended or adjusted under 35 U.S.C. 154(b) by 0 days.

(21) Appl. No.: 09/376,250

(22) Filed: Aug. 18, 1999

(51) Int. Cl.[7] ..... E02B 3/12; E02B 3/14
(52) U.S. Cl. ..... 405/16; 405/19
(58) Field of Search ..... 405/15, 16, 17, 405/21, 284, 286, 19, 20; 52/524, 530, 536, 539, 604

(56) References Cited

U.S. PATENT DOCUMENTS

| | | | | |
|---|---|---|---|---|
| 640,561 | * | 1/1900 | Henderson | 52/536 |
| 953,051 | * | 3/1910 | Muralt | 405/16 |
| 4,201,494 | | 5/1980 | Crowe | 405/17 |
| 4,372,705 | | 2/1983 | Atkinson | 405/19 |
| 4,436,447 | | 3/1984 | Crowe | 405/16 |
| 4,474,504 | | 10/1984 | Whitman | 405/16 |
| 4,603,529 | * | 8/1986 | Cronewett et al. | 52/536 |
| 4,661,012 | | 4/1987 | McCloskey | 405/16 |
| 4,661,014 | * | 4/1987 | Aubert | 405/21 X |
| 4,664,552 | | 5/1987 | Schaaf | 405/20 |
| 4,711,606 | * | 12/1987 | Leling et al. | 405/286 |
| 4,813,812 | * | 3/1989 | Hasegawa et al. | 405/16 |
| 5,020,938 | | 6/1991 | Scales | 405/16 |
| 5,429,450 | | 7/1995 | Meidinger | 405/15 |
| 5,484,230 | | 1/1996 | Rudloff | 405/20 |
| 5,499,891 | | 3/1996 | Klenert | 405/284 |
| 5,509,755 | * | 4/1996 | Olsen et al. | 405/21 |
| 5,556,228 | | 9/1996 | Smith | 405/16 |
| 5,827,015 | * | 10/1998 | Woolford et al. | 405/286 |

* cited by examiner

*Primary Examiner*—David Bagnell
*Assistant Examiner*—Sunil Singh
(74) *Attorney, Agent, or Firm*—David L. Ray

(57) ABSTRACT

An erosion control system for protecting a shoreline is provided comprising a first row of starter elements in contact with one another and fixedly attached to the shoreline; a second row of standard elements in contact with one another and matably engaged with the first row, such that the second row is closer to the shoreline and overlaps the first row in an interlocking manner; a third row of standard elements in contact with one another and matably engaged with the second row, such that the third row is closer to the shoreline and overlaps the second row; and wherein each successive row of standard elements is laterally offset from a previous row of standard elements.

16 Claims, 7 Drawing Sheets

EROSION CONTROL SYSTEM

BACKGROUND OF THE INVENTION

I. Field of the Invention

The present invention relates generally to the construction and use of interlocking and layered elements to form a protective shield against shoreline erosion.

II. Description of Prior Art

Shoreline erosion is one of the foremost concerns of persons living in coastal regions. The natural movement of water over beaches, shorelines, lakes and ponds leads inexorably to the deterioration of the land, which presents a variety of serious problems for nearby residents, commercial fisherman and farmers, and sportsmen. Repairs to these shorelines can be quite expensive, often costing millions of dollars in the case of public beaches and coastal areas. Even in small areas controlled by private property owners, the costs and effort to arrest the continuous erosion of the land can be excessive.

A wide variety of revetment structures or systems to control erosion have been developed with varying degrees of success. Some approaches rely upon large sheets of interlocking blocks strung together with cables, which are laid upon the shoreline by heavy machinery, such as that shown in U.S. Pat. No. 4,201,494. Other methods employ large numbers of "lock" blocks 20 having cavities formed along their perimeters which are connected to one another by "key" blocks, as depicted in U.S. Pat. No. 4,372,705. Still others, as illustrated by U.S. Pat. No. 5,020,938, require blocks having portions which overlap but which do not interlock.

From a review of the foregoing patents and others related to them, there is a need for an erosion control system for shorelines that uses a standard block or element to construct substantially the entire system. Moreover, it would be desirable for those elements to overlap and interlock with one another to provide the maximum protection for the underlying soil, while being less subject to theft and vandalism. Also, there is a need for such an erosion control system that can be constructed by starting from the upper region of the shoreline and working down to the waterline. The elements to such a shoreline protection system should be relatively inexpensive to manufacture and simple to install with little or no training or expertise.

SUMMARY OF THE INVENTION

It is therefore an object of this invention to provide an erosion control system having elements which can be interlockingly and overlappingly connected to one another.

It is also an object of this invention to provide an erosion control system having elements which allow construction of the assembly by starting at an upper region of the shoreline to be protected.

It is a further object of this invention to provide an erosion control system that is relatively easy to assemble and economical to install.

Yet another object of this invention is to provide an erosion control system that permits a variety of surface designs without departing from the interlocking and overlapping features.

These and other objects and advantages of the present invention will no doubt become apparent to those skilled in the art after having read the following description of the preferred embodiment which are contained in and illustrated by the various drawing figures.

Therefore, in a preferred embodiment, an erosion control element is provided, comprising a body formed of a substantially heavy material, said body having a base with a bottom surface shaped to contact a shoreline, first and second opposing sides, a front member, and a rear member; said front member comprising a downwardly extending convex terminal end, wherein said front member further includes a front concave recess adjacent to said downwardly extending convex terminal end; said rear member comprising an upwardly extending convex terminal end, wherein said rear member further includes a rear concave recess adjacent to said upwardly extending convex terminal end; wherein said downwardly extending convex terminal end of a first erosion control element is shaped and dimensioned to matably engage said rear concave recess of a second erosion control element; and wherein said upwardly extending convex terminal end of said first erosion control element is shaped and dimensioned to matably engage said front concave recess of a second erosion control element.

In a preferred embodiment, the front member includes an upper surface shaped in the form of a tile substantially parallel to said bottom surface of said base. In another embodiment, the front member includes an upper surface shaped in the form of a stair step. In all of the aforementioned embodiments, the invention is preferably constructed predominantly from a mixture of Portland cement and an aggregate material such as expanded clay, limestone granules, pea gravel, or other suitable filler material.

DETAILED DESCRIPTION OF THE PREFERRED EMBODIMENTS

Figure 1:
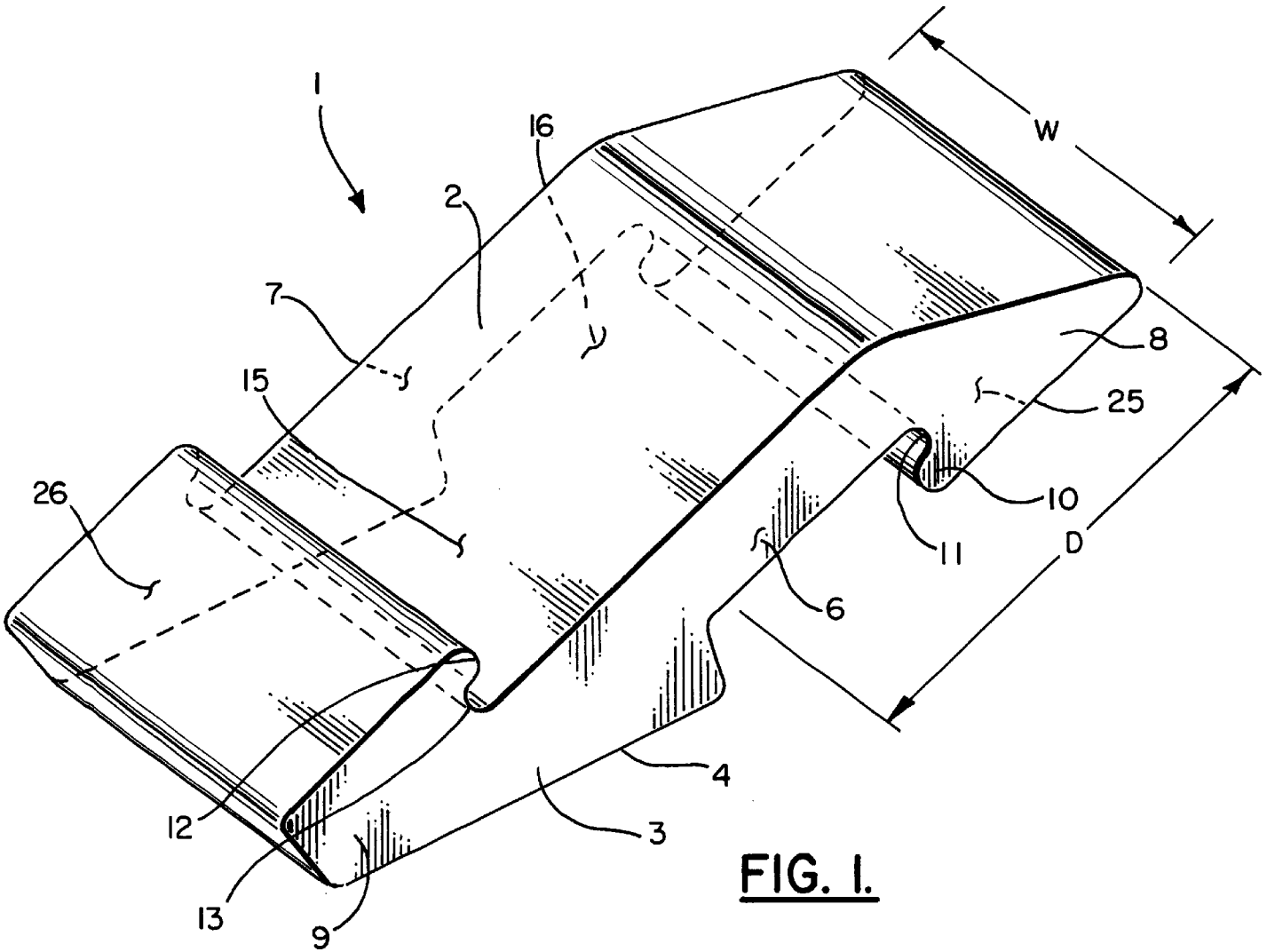
FIG. 1 is a perspective view of a preferred embodiment of an erosion control element.

Turning now to FIG. 1, an erosion control element 1 is shown to comprise a body 2 formed of a substantially heavy material, wherein the body 2 includes a base 3 with a bottom surface 4 shaped to contact a shoreline 5. The element 1 also includes first and second opposing sides 6,7, a front member 8, and a rear member 9. The front member 8 includes a downwardly extending convex terminal end 10 and a front concave recess 11, wherein the front concave recess 11 is adjacent to the convex terminal end 10. The rear member 9 includes an upwardly extending convex terminal end 12 and a rear concave recess 13, wherein the rear concave recess 13 is adjacent to convex terminal end 12. In a preferred embodiment, the front and rear members 8,9 extend across the entire width W of the body 2 between opposing sides 6,7. Importantly, the downwardly extending convex terminal end 10 of one erosion control element 1 is shaped and dimensioned to matably engage the rear concave recess 13 of a second erosion control element 1. Similarly, the upwardly extending convex terminal end 12 of one erosion control element I is shaped and dimensioned to matably engage the front concave recess 11 of a second erosion control element 1. The connections between erosion control elements 1 in the manner just described are shown more particularly in FIGS. 4 and 7. When assembled and placed onto a shoreline 5, the erosion control elements 1 form an erosion control system wherein the elements 1 are interlockingly connected to one another and wherein the elements 1 are caused to overlap one another. Specifically, as indicated in FIG. 1, the front member 8 overlaps elements 1 higher on the shoreline 5 by a distance D. The interlocking nature of the connection provides the needed strength of the engagement and assures that the elements will be prevented from separation over time and after long periods of exposure to wave action. The overlapping nature of the connection provides an effect similar to that provided by conventional roofing techniques in that the forces of the water and other external forces are completely prevented from reaching the underlying shoreline.

As mentioned previously, the elements 1 comprising the erosion control system are preferably constructed from a substantially heavy material so that the elements 1 make a firm contact with the shoreline and conform thereto over time. Examples of such material may include concrete, brick, and metals, or combinations thereof. For reasons of strength, resistance to cracking and economics, the applicant has determined that one suitable combination of materials would be the following:

| Component in mixture | Percent (by volume) |
|---|---|
| Cement | 11 |
| Sand | 23 |
| Expanded clay or limestone granules | 55 |
| Water | 10 |

Persons of ordinary skill in the art will appreciate that potentially many more combinations of materials may provide substantially equivalent results without significantly departing from the structural and functional integrity of the invention. For example, any combination comprised predominantly from a mixture of Portland cement and an aggregate material such as expanded clay, limestone granules, pea gravel, or other suitable filler material would also be within the scope of the present invention.

In each of the erosion control elements 1, the body 2 includes an upper surface 15 and an underside surface 16. Also, the front member 8 includes a lower surface 25, while the rear member 9 includes a top surface 26. When assembled, the elements 1 join such that the lower surface 25 of the front member 8 conforms to the upper surface 15 of the body 2. Likewise, the top surface 26 of the rear member 9 conforms to the underside surface 16 of the body 2. The aforementioned surfaces are shown in the figures to be flat, wherein the conforming relationships referred to are of a parallel nature. However, it is possible and potentially desirable that each of the aforementioned surfaces be formed in non-planar fashion so that the joining of these surfaces during assembly establishes further mating engagements which may add to the strength of the entire erosion control system.

Figure 2:
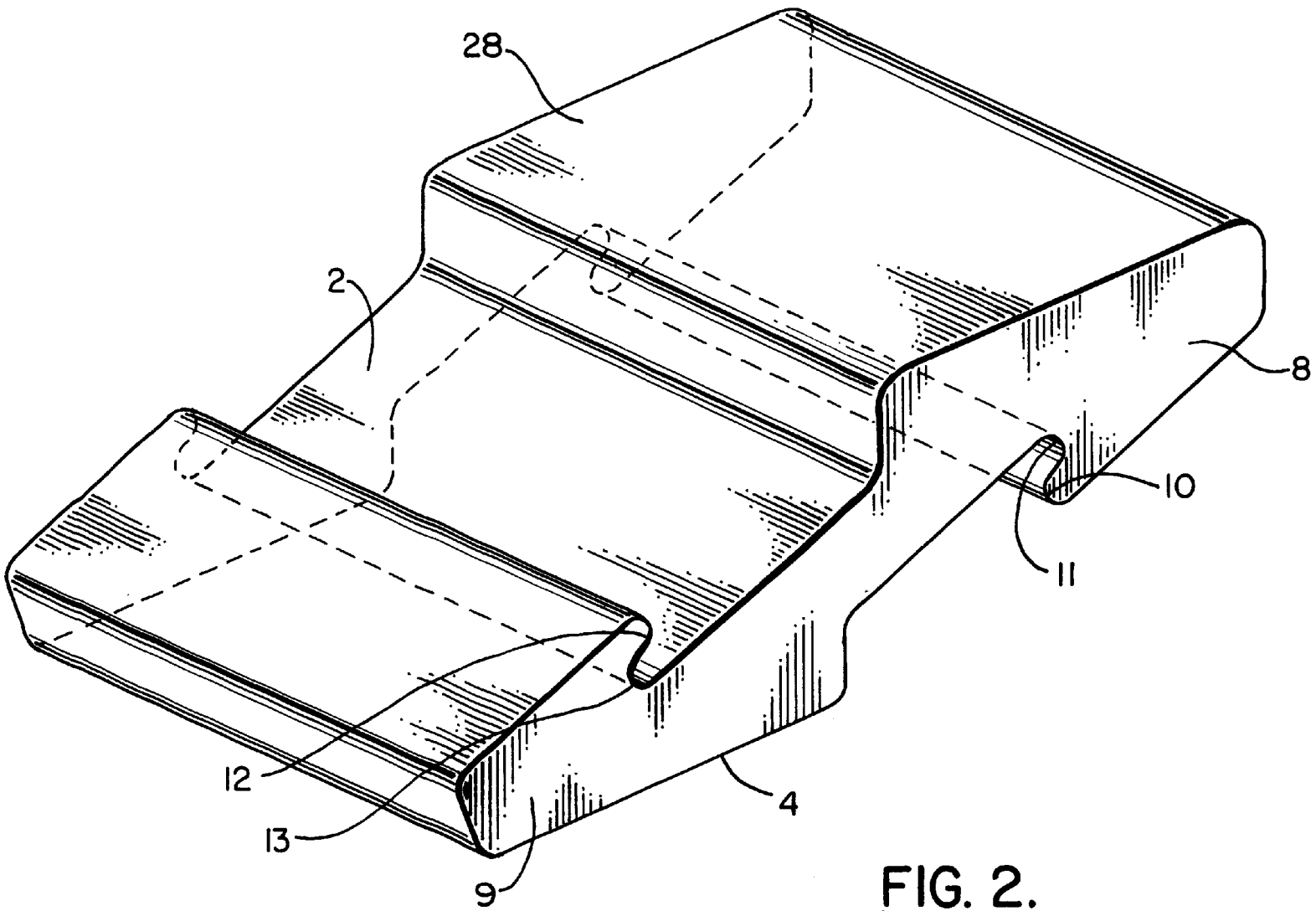
FIG. 2 is a perspective view of an alternate embodiment of an erosion control element having a tile- or stone-shaped top.

In FIG. 2, an alternate embodiment of the invention is shown wherein the front member 8 includes an upper surface 28 shaped in the form of a tile or stone surface substantially parallel to the bottom surface 4 of the base 3. With the exception of the tile surface 28, the structure and function of this embodiment is identical to the erosion control element 1 previously described in FIG. 1. In this embodiment, the tile surface 28 of each of the erosion control elements are closely adjacent to one another, such that the appearance of a flat, relatively uniform surface is created when the elements are assembled, as shown best in FIG. 5. Because the tile surface 28 is substantially parallel to the bottom surface 4 of the base 3, the tile surface 28 approximates the surface of the shoreline 5, thus preserving the natural slope of the terrain.

Figure 3:
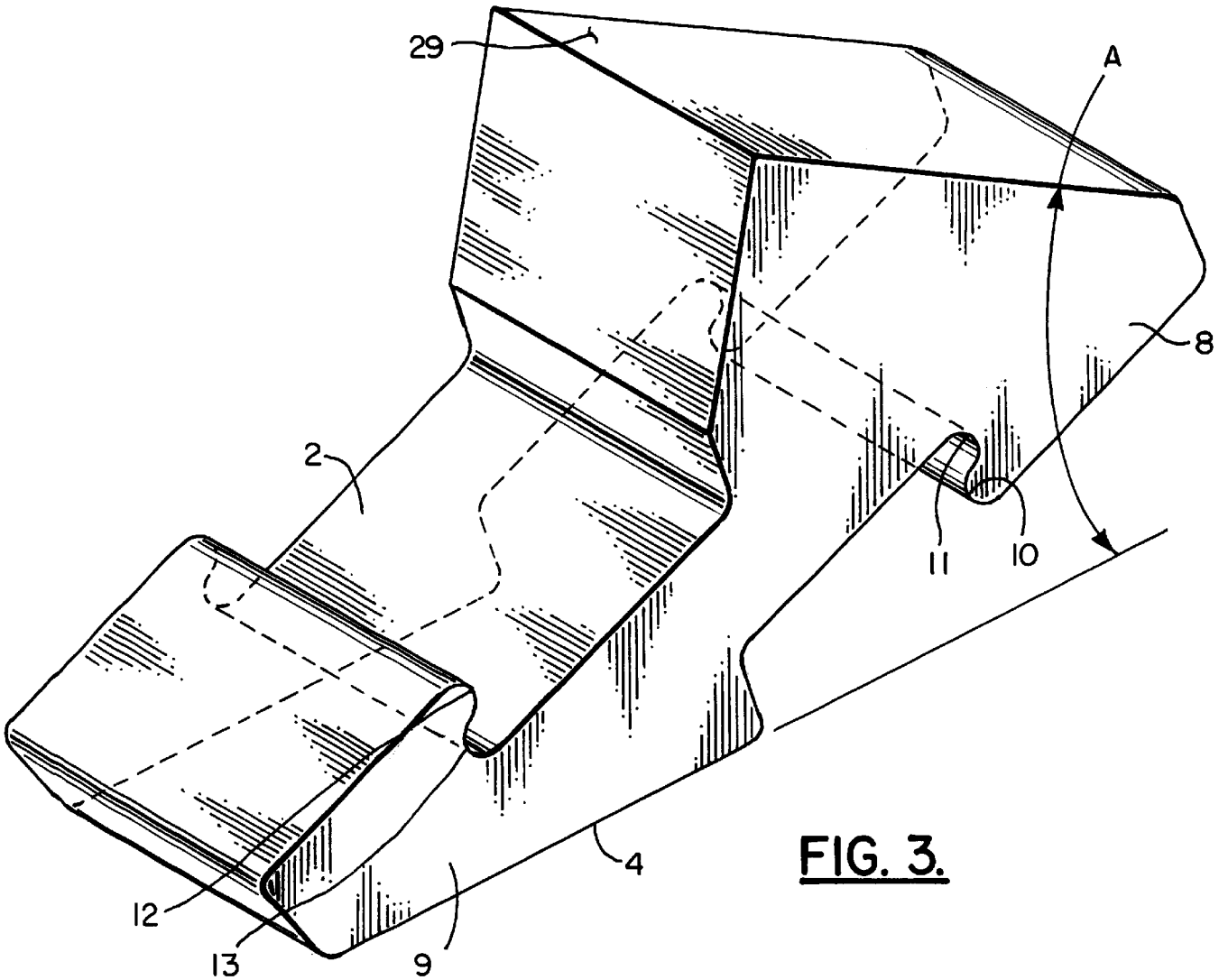
FIG. 3 is a perspective view of another alternate embodiment of an erosion control element having a stair-step top.
Figure 6:
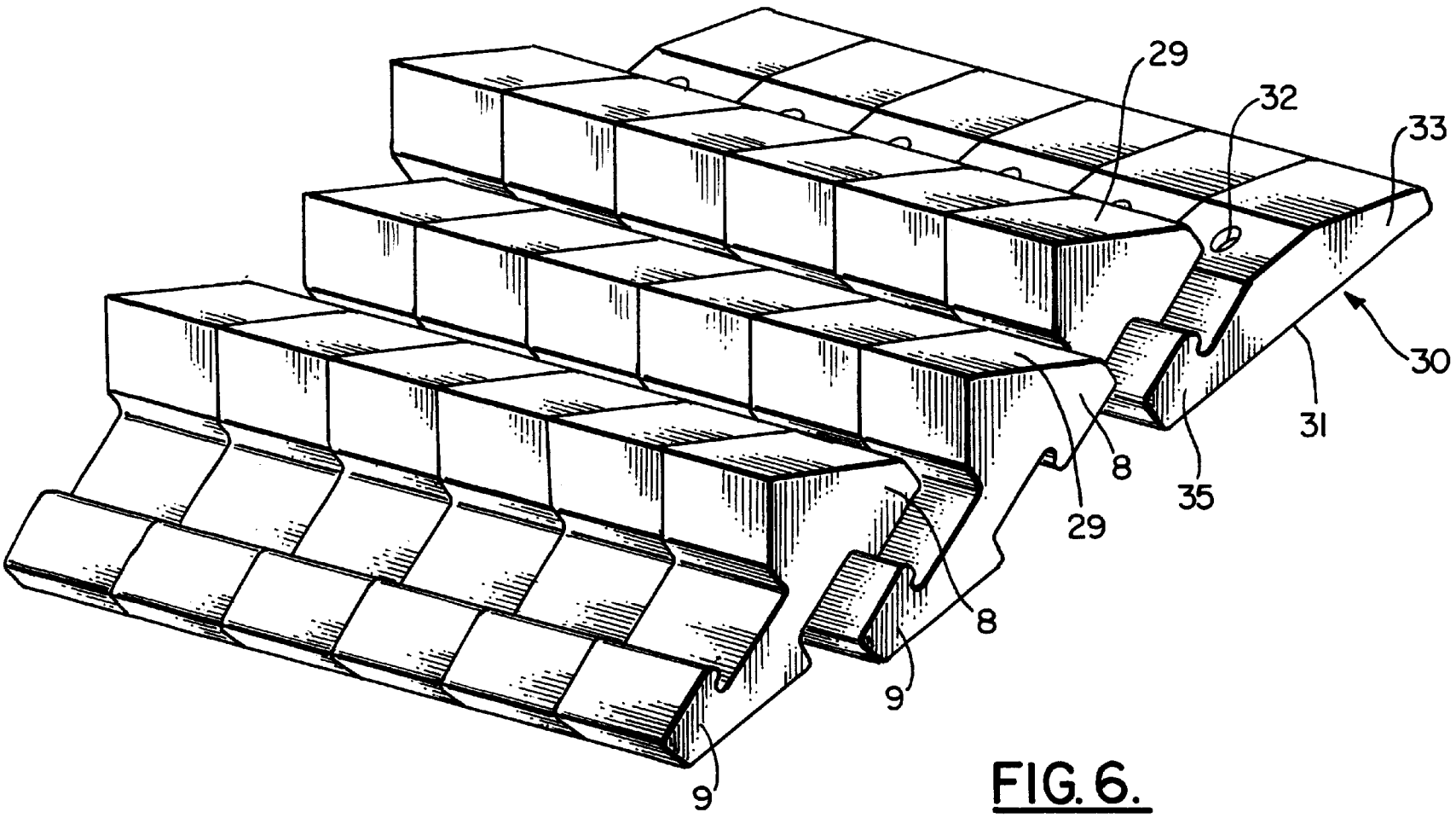
FIG. 6 illustrates an erosion control system in the form of an assembly of the erosion control elements of FIG. 3.

In FIG. 3, a further alternate embodiment of the invention is shown wherein the front member 8 includes an upper surface 29 shaped in the form of a stair step. With the exception of the stair step 29, the structure and function of this embodiment is identical to the erosion control element 1 previously described in FIG. 1. When the erosion control system is assembled using this embodiment, the shoreline 5 is protected in the same manner, but with the additional ability for persons to traverse the elements to and from the water line. Because the stair step surface 29 should be substantially horizontal when installed, the angle A between the base 4 and the stair step surface 29 should take into account the inclination of the shoreline 5 to be protected. FIG. 6 is an illustration of an assembly of the stair step embodiment clearly depicting the rows of steps created.

Although the elements may be constructed from a variety of sizes, the following is an example of typical dimensions for each element. The width W of each element may typically range from 12–18 inches, while the length may often range from 24–36 inches. Of course, larger dimensions will have the benefit of using fewer elements to construct the assembly, while smaller dimensions may allow the elements to be transported and handled more easily by laborers.

Figure 4:
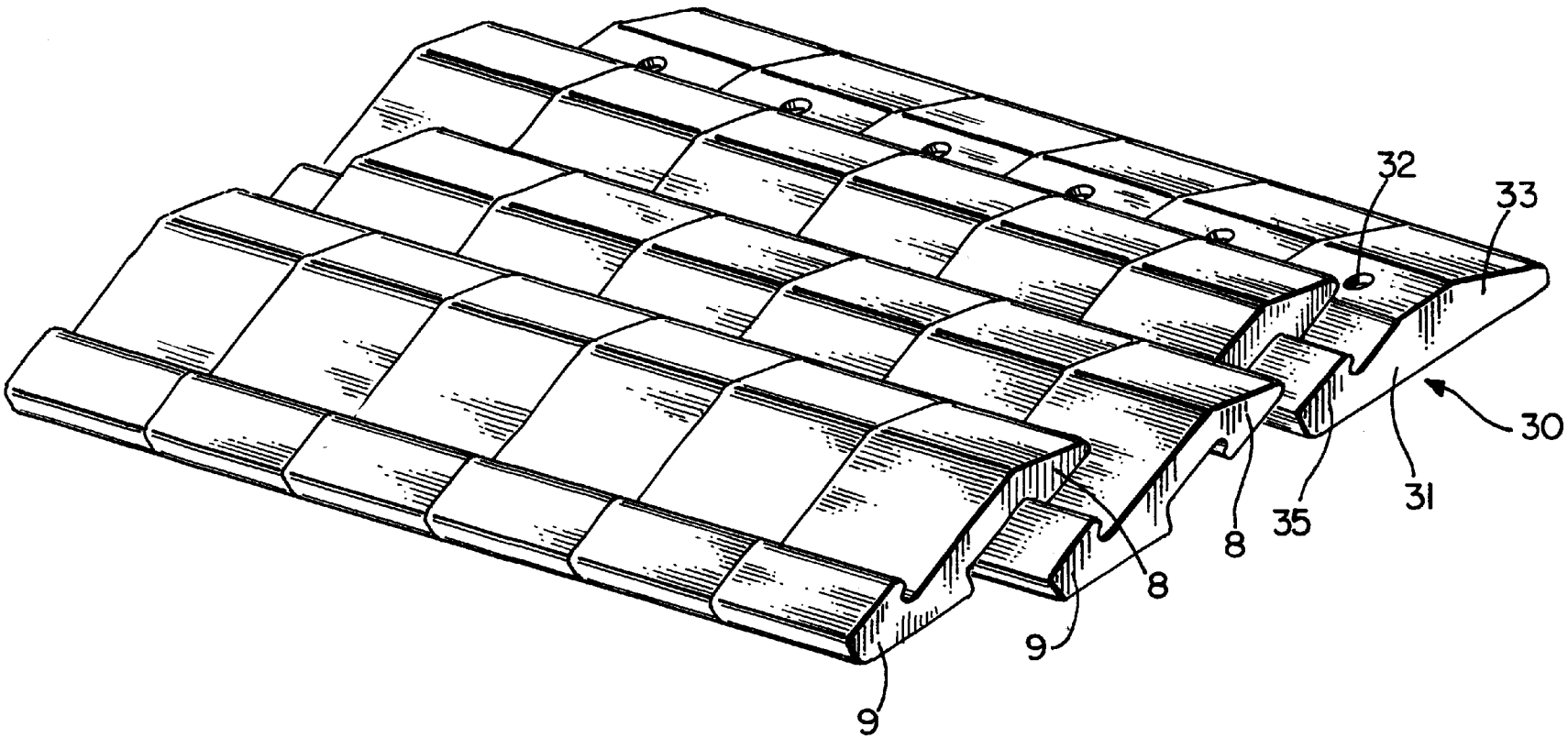
FIG. 4 illustrates an erosion control system in the form of an assembly of the erosion control elements of FIG. 1.
Figure 5:
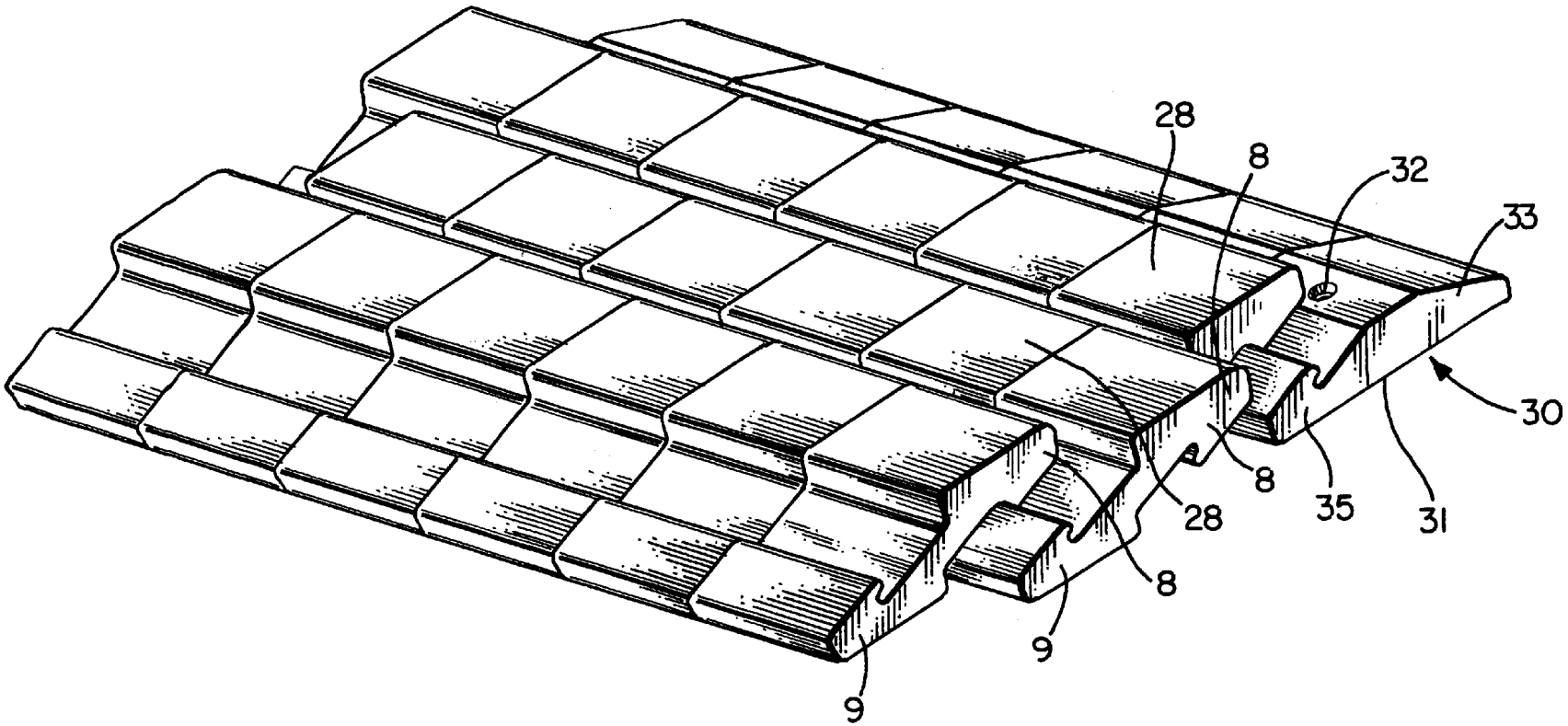
FIG. 5 illustrates an erosion control system in the form of an assembly of the erosion control elements of FIG. 2.

In each of the assemblies shown in FIGS. 4–6, the erosion control system is constructed by first inspecting the shoreline 5 to be protected. Ideally, the shoreline 5 should be graded or otherwise dressed as much as possible to a slope of roughly forty degrees (40°) or less. However, the appropriate slope of the shoreline will vary in particular cases depending on the composition of the shoreline. In some cases, it may desirable to cover the shoreline 5 with a light layer of beach sand to establish a more uniform surface over which to lay the elements. A straight line should be determined through the use of string or other methods known to those in the field for aligning the first row of starter elements 30. The assembly is commenced by placing a row of adjacent starter elements 30 in contact with one another.

Each starter element 30 is similar in many respects to the aforementioned embodiments, primarily due to the presence of a rear interlocking portion 35 that is matably engageable with the front member 8 of the previously described erosion control elements. Upon placement of the starter elements 30 on the shoreline 5, the rear interlocking portion 35 is directed toward the waterline. However, rather than having a front interlocking member on the front portion 33 of each starter element 30, the starter element 30 includes a flat bottom surface 31 and a hole 32 formed completely through the element 30. When assembled, a fixation device 34, such as bolt or threaded rod, is passed through the hole 32 in each starter element 30 and embedded deeply into the shoreline 5. For ease of installation, it is preferred that the fixation device 34 include a socket head 36 that may be engaged by a suitable power tool. In this method, the starter elements 30 are firmly connected to the shoreline 5 and ready for the placement of the next row of erosion control elements 1 of either FIG. 1, 2, or 3. Preferably, the hole 32 for the fixation device 34 includes a counterbore 37 to allow the fixation device 34 and its socket head 36 to be recessed below the top of the starter element 30. As each row of erosion control elements is placed, the elements are laterally offset or "staggered" from the adjacent row immediately above it by roughly fifty percent of the width of each element, such that the elements are assembled similarly to methods used in the bricklaying art.

Figure 7:
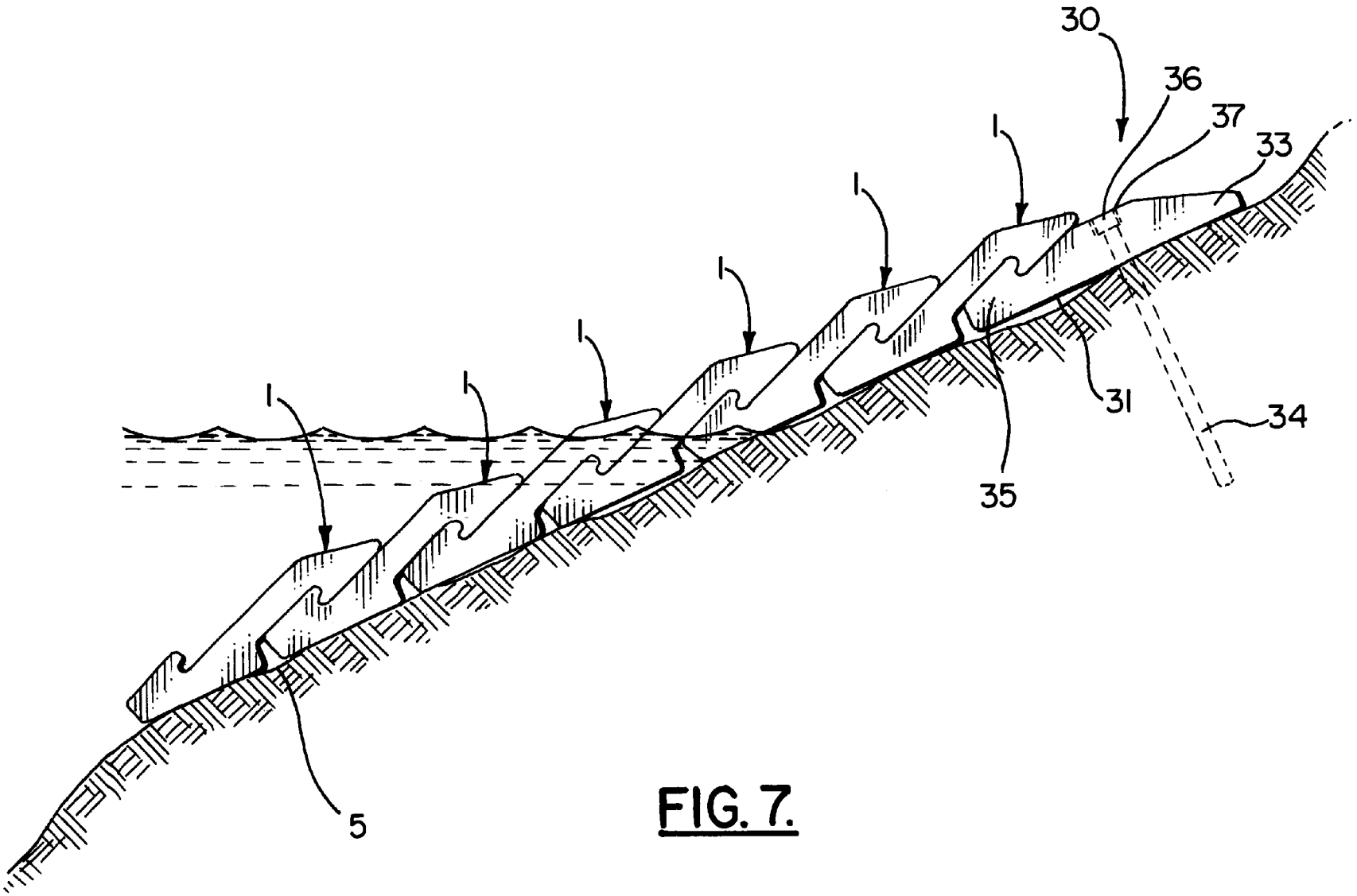
FIG. 7 is an elevation view of an erosion control system applied to a shoreline.

Due to the structure of the erosion control elements of FIGS. 1–3, the erosion control system of the present invention derives several distinct and important advantages. First, installations of these types of protection systems are generally done with the intention of preserving the shoreline 5 on a long term basis. The interlocking and overlapping relationship between the elements requires that the starter elements 30 be placed first, followed by each successive row of "standard" elements toward and below the waterline until the desired depth is reached as shown in FIG. 7. Generally, the bottom Tow of the assembly should reside below the level of tide effects and wave action. Once the erosion control system is constructed, it may only be disassembled by removing elements from the bottom row beneath the waterline. Therefore, by its design and assembly technique, the present invention offers a high level of permanence, as well as a significant deterrence against theft or vandalism of the elements.

Furthermore, the interlocking nature of the system can compensate for slightly uneven shorelines, such that the natural settling of the elements will serve to level the underlying ground over time. With respect to the tile or stone shaped elements of FIGS. 2 and 5, a friction pattern can be applied or formed into the elements such that the erosion control system may also serve as a ramp for use with boat trailers.

The invention has particular utility in the protection of shorelines on barrier islands of Louisiana and other states bordering on the Gulf of Mexico. The relatively shallow slope of the shorelines in these regions make the invention ideally suited to use on such shorelines. For use in connection with such large projects, the elements can be constructed using larger dimensions suited to being handled and installed by heavy machinery. Enhanced reinforcements can be added by forming additional holes through the bodies of other elements and employing additional fixation members at predetermined intervals throughout the assembly.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. An erosion control element for protecting a gradually sloping shoreline from erosion, said erosion control element comprising:

a. a body formed of a substantially heavy material, said body having a top and a bottom, said bottom having a base with a bottom surface for contacting said shoreline, said body having first and second opposing sides, a front member, and a rear member;

said front member comprising a downwardly extending convex terminal end, wherein said front member further includes a rearward facing front concave recess on said bottom of said body adjacent to said downwardly extending convex terminal end;

said rear member comprising an upwardly extending convex terminal end, wherein said rear member further includes a forward facing rear concave recess on said top of said body adjacent to said upwardly extending convex terminal end;

wherein said downwardly extending convex terminal end of said erosion control element being shaped and dimensioned to matably engage and interlock with a rear concave recess of a second erosion control element; and wherein said upwardly extending convex terminal end of said erosion control element is shaped and dimensioned to matably engage and interlock with a front concave recess of a third erosion control element.

2. The erosion control element of claim 1, wherein said front member and said rear member extend completely across said body between said opposing sides.

3. The erosion control element of claim 2, wherein said body includes an upper surface, wherein said front member includes a lower surface, and wherein said lower surface of said erosion control element is shaped to conform to an upper surface of said second erosion control element.

4. The erosion control element of claim 3, wherein said body includes an underside surface, wherein said rear member includes a top surface, and wherein said top surface of said erosion control element is shaped to conform to an underside surface of said third erosion control element.

5. The erosion control element of claim 4 wherein said opposing sides are parallel.

6. The erosion control element of claim 1, wherein said erosion control element is constructed predominantly from a mixture of Portland cement and an aggregate material selected from the group consisting of expanded clay, limestone granules, pea gravel, or other suitable filler material.

7. The erosion control element of claim 1, wherein said front member includes an upper surface shaped in the form of a tile substantially parallel to said bottom surface of said base.

8. The erosion control element of claim 1, wherein said front member includes an upper surface shaped in the form of a stair step.

9. The erosion control element of claim 1 wherein said opposing sides are parallel.

10. An erosion control system for protecting a gradually sloping shoreline, comprising:

A. a plurality of standard elements, each of said standard elements comprising:

a body formed of a substantially heavy material, said body having a base with a bottom surface shaped to contact a shoreline, first and second opposing sides, a front member, and a rear member;

said front member comprising a downwardly extending convex terminal end, wherein said front member further includes a front concave recess adjacent to said downwardly extending convex terminal end;

said rear member comprising an upwardly extending convex terminal end, wherein said rear member further includes a rear concave recess adjacent to said upwardly extending convex terminal end;

wherein said downwardly extending convex terminal end of each of said standard elements is shaped and dimensioned to matably engage and interlock with a rear concave recess of a second of said standard elements; and wherein said upwardly extending convex terminal end of each of said standard elements is shaped and dimensioned to matably engage and interlock with a front concave recess of a third of said standard elements;

B. a plurality of starter elements, each of said starter elements comprising:

a body formed of a substantially heavy material, said body having a base with a bottom surface shaped to contact a shoreline, first and second opposing sides, a front portion, and an interlocking member;

said front portion including a fixation hole formed therethrough for accepting a fixation device; and said interlocking member comprising an upwardly extending convex terminal end, wherein said interlocking member further includes a rear concave recess adjacent to said upwardly extending convex terminal end of said interlocking member;

wherein each of said starter elements are adapted to be fixed to said shoreline by a fixation device adapted to pass through said fixation hole and to penetrate into the surface upon which said starter elements are to be placed, said starter elements being oriented such that said interlocking member of each of said starter elements is adapted to be directed toward a water line and such that said first and second opposing sides of adjacent said starter elements are in contact with one another; and wherein said front member of each of said standard elements are matably engaged and interlocked with said interlocking member of said starter elements, such that said first and second opposing sides of adjacent said standard elements are in contact with one another, and such that said first and second opposing sides of said standard elements are offset from said first and second opposing sides of said starter elements.

11. The erosion control system of claim 10, wherein said front member and said rear member extend completely across said body between said opposing sides.

12. The erosion control system of claim 11, wherein said body includes an upper surface, wherein said front member includes a lower surface, and wherein said lower surface of each of said standard elements is shaped to conform to an upper surface of said second standard elements.

13. The erosion control system of claim 12, wherein said body includes an underside surface, wherein said rear member includes a top surface, and wherein said top surface of each of said standard elements is shaped to conform to an underside surface of said third standard elements.

14. The erosion control system of claim 10, wherein said erosion control element is constructed predominantly from a mixture of Portland cement and an aggregate material selected from the group consisting of expanded clay, limestone granules, pea gravel, or other suitable filler material.

15. The erosion control element of claim 10, wherein said front member includes an upper surface shaped in the form of a tile substantially parallel to said bottom surface of said base.

16. The erosion control element of claim 10 wherein said front member includes an upper surface shaped in the form of a stair step.

* * * * *